US010016907B2

(12) United States Patent
Song et al.

(10) Patent No.: US 10,016,907 B2
(45) Date of Patent: Jul. 10, 2018

(54) DIE-CUTTING SCRAP REMOVAL DEVICE

(71) Applicants: Byung-jun Song, Seoul (KR); Ju-hyun Song, Seoul (KR)

(72) Inventors: Byung-jun Song, Seoul (KR); Ju-hyun Song, Seoul (KR)

( * ) Notice: Subject to any disclaimer, the term of this patent is extended or adjusted under 35 U.S.C. 154(b) by 0 days.

(21) Appl. No.: 15/113,535

(22) PCT Filed: Apr. 28, 2014

(86) PCT No.: PCT/KR2014/003735
§ 371 (c)(1),
(2) Date: Jul. 22, 2016

(87) PCT Pub. No.: WO2015/111802
PCT Pub. Date: Jul. 30, 2015

(65) Prior Publication Data

US 2017/0008185 A1 Jan. 12, 2017

(30) Foreign Application Priority Data

Jan. 22, 2014 (KR) ..... 10-2014-0007547

(51) Int. Cl.
*B26D 7/18* (2006.01)
*B31B 100/00* (2017.01)
(Continued)

(52) U.S. Cl.
CPC ..... *B26D 7/1818* (2013.01); *B26D 7/18* (2013.01); *B31B 50/142* (2017.08); *B31B 2100/00* (2017.08); *B31B 2110/35* (2017.08)

(58) Field of Classification Search
CPC . B26D 7/18; B26D 7/1818; B26F 1/40; B26F 1/44; B31B 2100/00;
(Continued)

(56) References Cited

U.S. PATENT DOCUMENTS 4,439,123 A * 3/1984 Sano ..... B29C 43/203 425/112
4,703,644 A * 11/1987 Waldner ..... B21D 37/10 100/917
(Continued)

FOREIGN PATENT DOCUMENTS

JP 2000117694 A 4/2000
JP 2001121484 A 5/2001
(Continued)

OTHER PUBLICATIONS

PCT International Search Report of PCT/KR2014/003735.
PCT Written Opinion of the International Searching Authority of PCT/KR2014/003735.

*Primary Examiner* — Stephen Choi
(74) *Attorney, Agent, or Firm* — KORUS Patent, LLC; Seong Il Jeong

(57) ABSTRACT

A die-cutting scrap removal device for separating a product from an original plate is provided. The die-cutting scrap removal device includes a table-shaped removal main body part configured to stand upright on the ground surface; a first pressing-separation part fixed on the top surface of the removal main body part so as to move vertically; and a second pressing-separation part moving in the back and forth directions and the vertical direction on the top surface of the removal main body part, thereby readily separating scraps in mass quantities of products.

8 Claims, 8 Drawing Sheets

(51) Int. Cl.
*B31B 50/14* (2017.01)
*B31B 110/35* (2017.01)

(58) Field of Classification Search
CPC ..... B31B 2110/35; B31B 50/142; Y10T 83/2074; Y10T 83/2092
See application file for complete search history.

(56) References Cited

U.S. PATENT DOCUMENTS 5,409,368 A * 4/1995 Heiskell ..... B26D 7/1818 264/153
5,417,133 A * 5/1995 Bakermans ..... B26D 7/1818 83/146

FOREIGN PATENT DOCUMENTS

JP 2002018789 A 1/2002
KR 1020120117179 10/2012
KR 1014075290000 6/2014

* cited by examiner

Prior Art

Prior Art

DIE-CUTTING SCRAP REMOVAL DEVICE

CROSS-REFERENCE TO PRIOR APPLICATIONS

This application is a National Stage Patent Application of PCT International Patent Application No. PCT/KR2014/003735 (filed Apr. 28, 2014) under 35 U.S.C. §371, which claims the benefit of foreign priority of Korean Patent Application No. 10-2014-0007547 (filed Jan. 22, 2014), the subject matter of which is hereby incorporated by reference in its entirety.

BACKGROUND

Technical Field

The present invention relates to a die-cutting scrap removal device, and in particular to a die-cutting scrap removal device which is provided with a scrap removal part formed of a fixed pressing-separation part configured to vertically move for a product and scraps to easily separate from a plurality of die-cut original plates, and a movable pressing-separation part configured to move vertically and back and forth behind the fixed pressing-separation part, wherein an elevating cylinder part and an elevating rotary shaft unit, which performs the function of a rotary shaft, are disposed at a lower portion in order for the movable pressing-separation part to rotate at a predetermined angle.

Background Art

In recent years, a product used, for example, in engineering, industrial and actual life sectors is being manufactured in various sizes and shapes. To this end, a packing box configured to pack such a product is being manufactured in various sizes and shapes.

The packing box, in general, is configured in a polyhedron structure wherein a product is accommodated. The packing box may be formed in such a way that a raw material, for example, a thick paper is cut into a plane planar figure, and the cut plane planar figure is folded. The cutting of a plane planar figure the size and shape of which have been previously set, is called a die-cutting.

FIG. 1 is a planar view illustrating in a die-cut packing box. As evident from FIG. 1, a lot of packing box planar figures are die-cut on one original plate 2. In the course of the die-cutting wherein the material gets impressed, a cutting procedure is, in general, carried out in such a way that predetermined portions are connected, not cutting the front side of a planar figure, so as to prevent a corresponding planar figure of the packing box from separating from the original plate after the cutting has been just carried out.

When one packing box is manufactured on an original plate wherein a lot of packing box planar figures have got impressed, a procedure to individually separate a die-cut planar figure, namely, a packing box and a scrap, is necessarily carried out. This procedure should be manually carried out by a worker. For this reason, the worker should inevitably perform a lot of works in case of a mass production, which may lead to increased labor costs, thus consequently causing a problem in terms of the mass production.

The same applicant as the present invention invented the Korean patent laid-open No. 10-2012-0117179 in an effort to solve the aforementioned problem.

FIG. 2 is a side view illustrating a conventional die-cutting scrap removal device. The aforementioned conventional die-cutting scrap removal device is formed of a frame shelf 3 on which the original plates 2 the planar figure of which has been die-cut, are mounted as illustrated in FIG. 2, presses 4, 5 and 6 which descend from above the frame shelf 3 and pressurize the original plates 2, and a separation shelf 7 which moves upward or downward from the frame shelf 3 in a state where a part of a corresponding original plate 2 has moved and fixed by the presses 4, 5 and 6, thus separating a part of the corresponding original plates 2.

In the conventional die-cutting scrap removal device, a separation work should be carried out with the aid of only a plurality of presses which are configured to move at different heights, respectively, when a product and scraps are separated from a plurality of stacked original plates 2, for which the products may be partially ripped off or damaged since the product and the scraps are not accurately separated.

SUMMARY OF THE DISCLOSURE

The present invention has been made in an effort to solve the above-described problems associated with prior art. It is an object of the present invention to provide a die-cutting scrap removal device which is provided with a scrap removal part formed of a fixed pressing-separation part configured to vertically move for a product and scraps to easily separate from a plurality of die-cut original plates, and a movable pressing-separation part configured to move vertically and back and forth behind the fixed pressing-separation part, by means of which scraps can be easily separated from a lot of scraps. A forward and backward movement guide bar and a forward and backward movement guide plate are disposed at both sides of the movable pressing-separation part, so the movable pressing-separation part can be easily moved in the forward and backward directions. A pressing pin protruding in one direction or a plane is formed at one surface thereof, whereby a pressing body can be defined, which is able to rotate in response to a predetermined operation, thus preventing any damage to the product during the separating work of the scraps. An elevating cylinder part and an elevating rotary shaft part which is configured to perform the function of a rotary shaft are disposed below the movable pressing-separation plate, so the movable pressing-separation plate can be movable at a predetermined angle.

To achieve the above objects, there is provided a die-cutting scrap removal device configured to separate a product from an original plate on which a plurality of products have been die-cut, which may include a scrap removal means which includes a table-shaped removal main body part which stands upright on the ground, a fixed pressing-separation part which is fixed on the upper surface of the removal main body part and is configured to move vertically, and a movable pressing-separation part which is able to move back and forth and vertically on the upper surface of the removal main body part, wherein the fixed pressing-separation part includes a fixed pressing plate on which an original plate loaded on the top of the removal main body part, is mounted, a fixed pressing part which moves vertically above the fixed pressing plate and is connected passing through for the original plate to be pressed, and a fixed pressing cylinder which is disposed below the fixed pressing plate and is configured to move vertically the fixed pressing part, and wherein the movable pressing-separation part includes a movable pressing plate which is disposed horizontal behind the fixed pressing plate and is configured to move back and forth, a movable pressing part which is configured to move vertically above the movable pressing plate and is connected passing through for the original plate to be pressed, and a movable pressing cylinder which is disposed below the movable pressing plate and is configured to move vertically the movable pressing part.

A pair of fixed vertical shaft rods are disposed at the fixed pressing-separation part so as to guide the vertical movements of the fixed pressing part, and a fixed pressing transfer plate is disposed at a lower end portion of the fixed vertical shaft rod and is connected to the fixed pressing cylinder and is able to move the fixed pressing part, and a pair of movable vertical shaft rods are disposed at the movable pressing-separation part so as to guide the vertical movement of the movable pressing part, and a movable pressing transfer plate is disposed at a lower end portion of the movable vertical shaft rod is connected to the movable pressing cylinder and is able to move the movable pressing part.

The fixed pressing part includes a quadrangular rod-shaped fixed pressing body, a Π-shaped fixed pressing body frame to which both ends of the fixing pressing body are connected rotatable, and a fixed rotation motor which is disposed at one side of the fixed pressing body frame and is configured to rotate the fixed pressing body, and the movable pressing part includes a quadrangle rod-shaped movable pressing body, a Π-shaped movable pressing body frame to which both ends of the movable pressing body are connected rotatable, and a movable rotation motor which is disposed at one side of the movable pressing body frame and is able to rotate the movable pressing body.

A pin fixing surface is formed at one surface of each of the fixed pressing body and the movable pressing body, wherein the pin fixing surface is formed of a pressing pin which allows one point of the original plate to be pressed and fixed, and a pin engaging hole which is formed inwardly concave for the pressing pin to be fixed, and a plane fixed surface is formed at the other surface thereof for another point of the original plate to be pressed and fixed.

The pressing pin includes a mounting part which is mounted on the pin fixing surface, and a pressing part which is bent at a right angle at an end portion of the mounting part, and a longitudinal bolt through hole is formed at one surface of the mounting part for an engaging bolt to pass through the longitudinal bolt through hole.

An engaging groove is formed at an inner side of the pin engaging hole, wherein the engaging groove is formed outwardly concave, and an engaging nut is provided at the engaging groove and is engaged with the engaging bolt, wherein the engaging nut is larger than the inner diameter of the pin engaging hole for the pressing pin to be fixed.

A forward and backward movement guide bar is formed at both sides of the movable pressing plate while protruding in the direction of the fixed pressing plate, wherein a slide insertion hole is formed inside the forward and backward movement guide bar, and a plate-shaped forward and backward movement guide plate is disposed on the upper surface of the removal main body part, wherein the slide insertion rod inserted in the slide insertion hole is formed horizontal, and a forward and backward movement cylinder is provided below the forward and backward movement guide bar and is configured to push the forward and backward movement guide plate.

A rotation hinge part is disposed at an end portion of the forward and backward movement guide bar while being fixed at both sides of the movable pressing plate so as to rotate in the upward and downward directions of the movable pressing plate, wherein the rotation hinge part is hinged at an end portion of the forward and backward movement guide bar.

An elevating cylinder part is disposed at the lower surface of one side of the movable pressing plate and is configured to elevate the movable pressing plate in order for the movable pressing plate to move at a predetermined angle. An elevating rotary shaft part is disposed at an upper end portion of the elevating cylinder part and is connected to the movable pressing plate so as to rotate during the elevating operation.

Advantageous Effects

The die-cutting scrap removal device according to the present invention has the following advantageous effects.

First, since the die-cutting scrap removal device is provided with a scrap removal part formed of a fixed pressing-separation part configured to vertically move for a product and scraps to easily separate from die-cut original plates, and a movable pressing-separation part configured to move vertically and back and forth at the same time behind the fixed pressing-separation part, a work to separate scraps from a lot of products die-cut on the original plate can be readily carried out, which may result in an increased production rate.

Second, a forward and backward movement guide bar is provided, wherein a slide insertion hole is formed at both sides of the movable pressing-separation part, and a forward and backward movement guide plate is provided, wherein a slide insertion rod inserted in the slide insertion hole is formed at a removal main body part, by means of which it is possible to prevent a movement trajectory from being deformed when the movable pressing-separation part moves back and forth, thus allowing the movable pressing-separation part to operate accurately.

Third, there are provided a pin fixing surface to which a pressing pin is engaged so as to enhance a fixing force at a surface during the pressing and fixing of the original plate, and a plurality of pressing bodies disposed at the other surface, wherein a plane fixing surface is formed to prevent any damage to the surface of the product. Any damages to the products, therefore, can be prevented during the work to separate the scraps from the products by variably rotating the pressing body in such a way that the side where the products position is pressed by the plane fixing surface during the pressing and fixing of the original plate, and the side where the scraps position is pressed by the pin fixing surface.

Fourth, there are provided an elevating cylinder part provided below the movable pressing plate and configured in order for the movable pressing plate to move at a predetermined angle, and an elevating rotary shaft part configured to carry out the function of a rotary shaft, whereby a separation work can be more readily carried out in such a way to bend and separate at a predetermined angle a plurality of stacked original plates before the movable pressing-separation part moves backward.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIG. 8 is a side view illustrating a scrap removal part according to an embodiment of the present invention, of which

DETAILED DESCRIPTION

Figure 1:
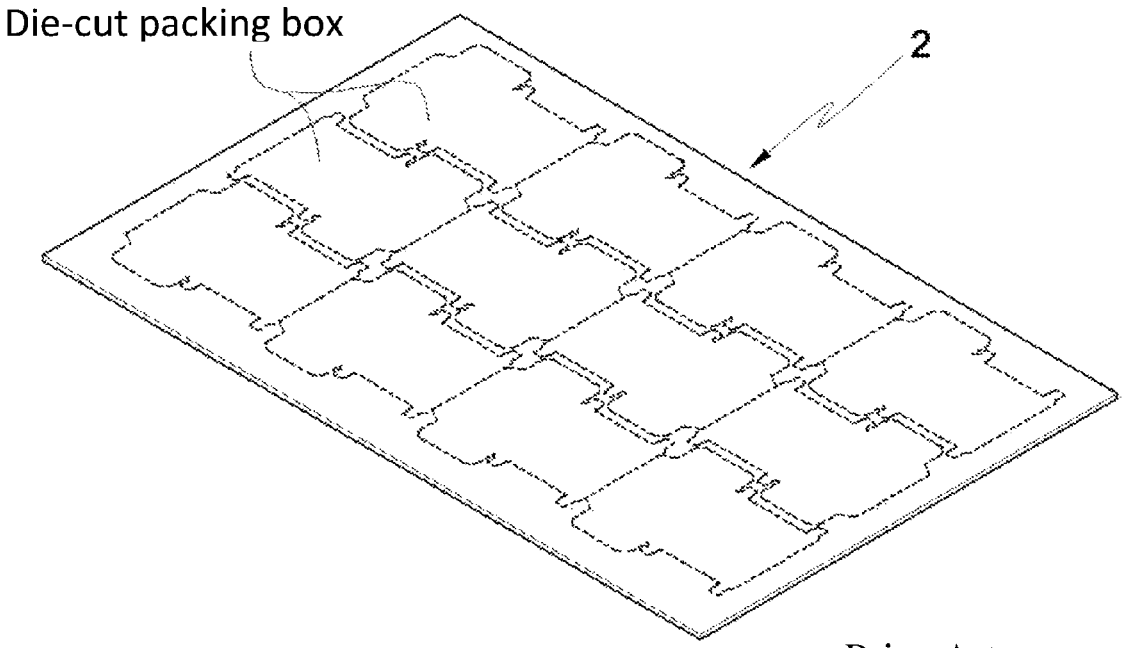
FIG. 1 is a planar figure view illustrating a conventional die-cut packing box.
Figure 2:
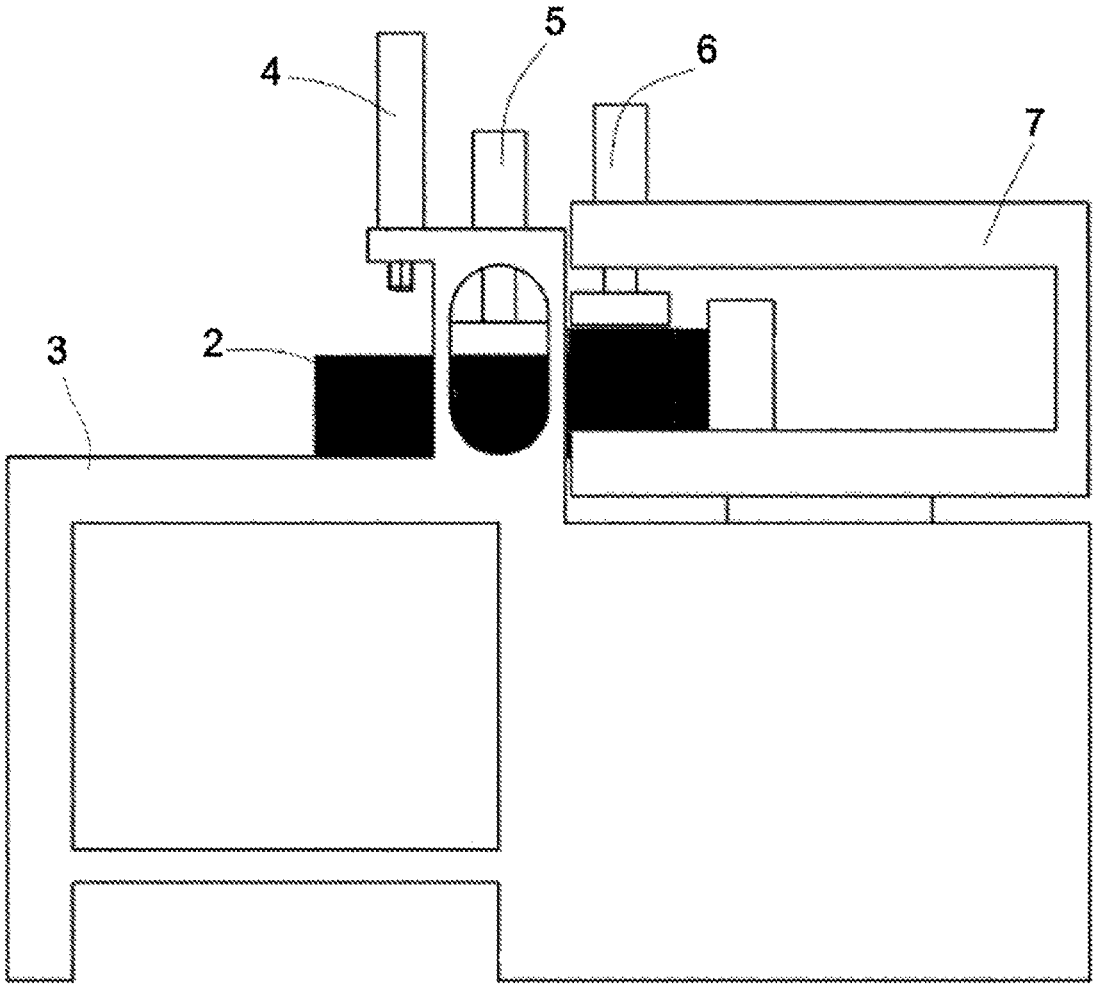
FIG. 2 is a side view illustrating a conventional die-cutting scrap removal device.
Figure 3:
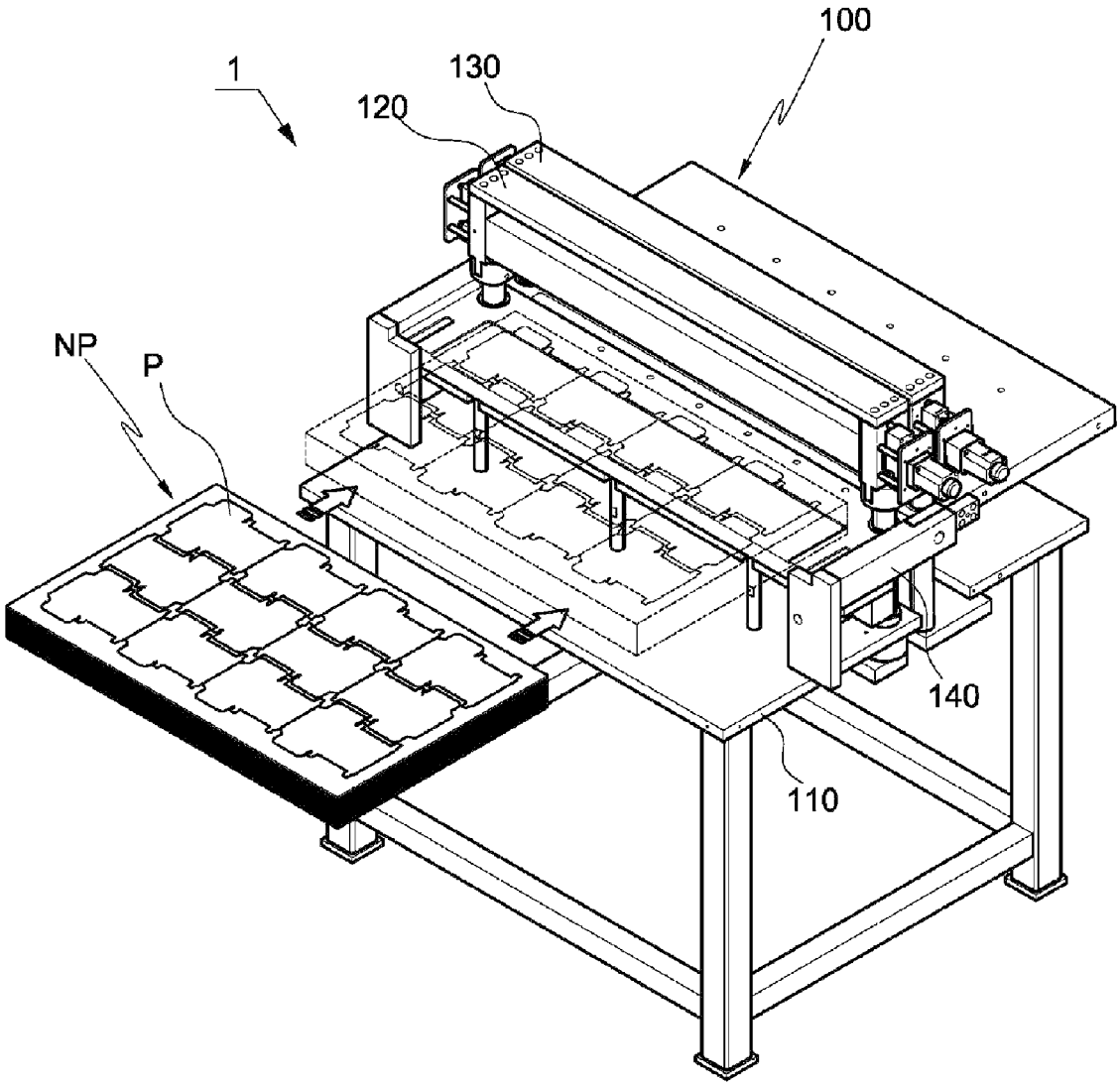
FIG. 3 is a perspective view illustrating a die-cutting scrap removal device according to the present invention.
Figure 4:
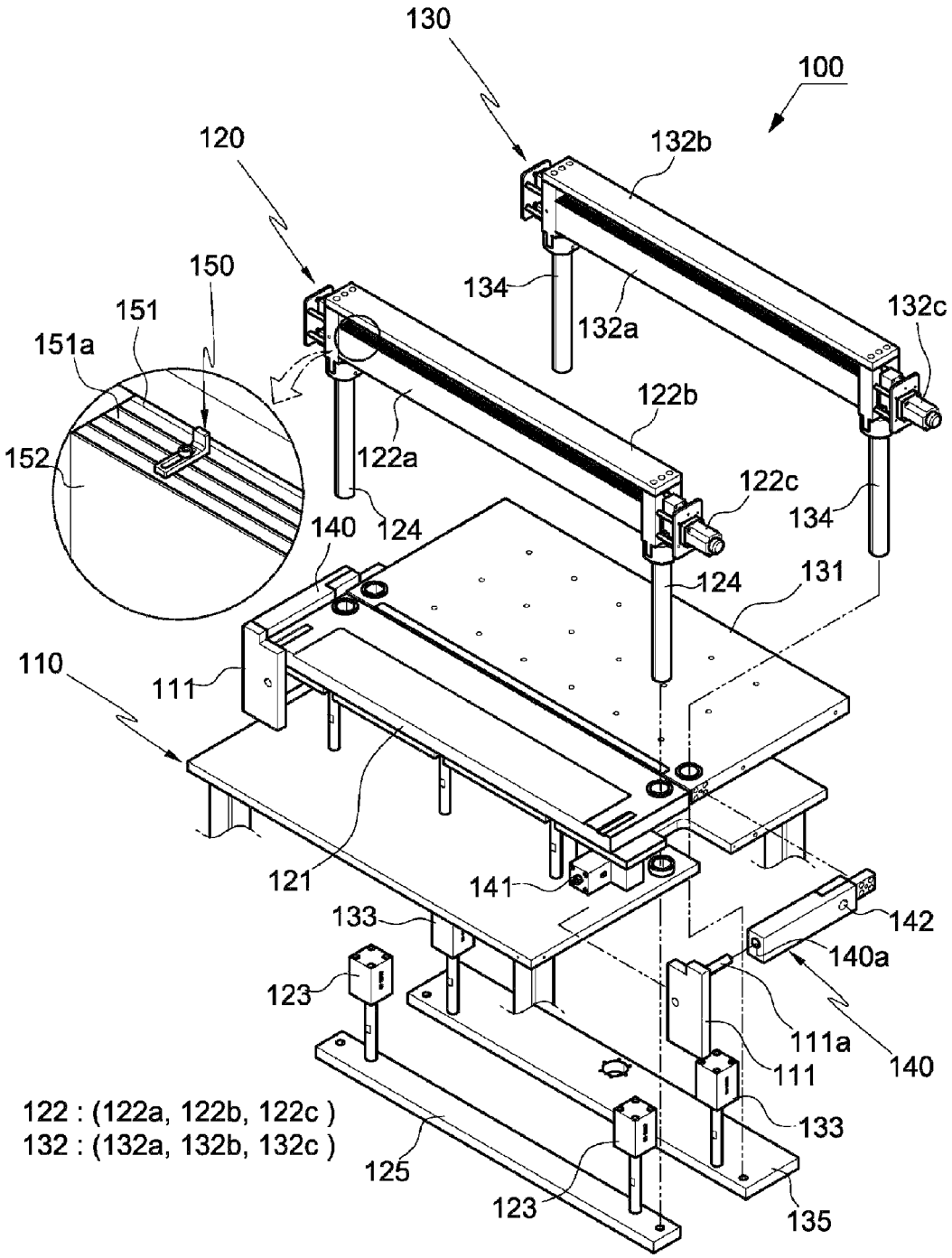
FIG. 4 is a disassembled perspective view illustrating a scrap removal part according to the present invention.
Figure 5:
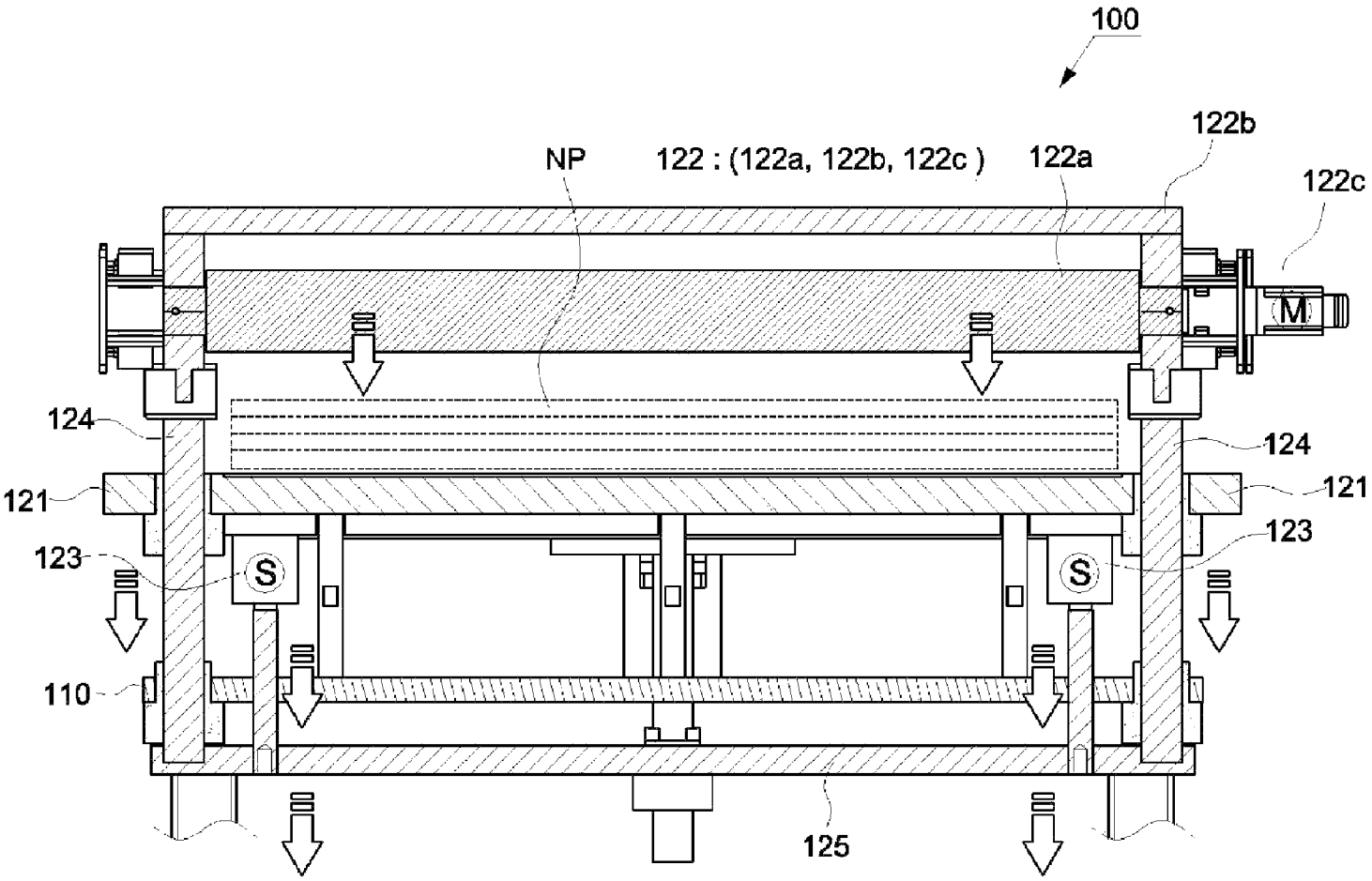
FIG. 5 is a front view illustrating a scrap removal part according to an embodiment of the present invention.

The preferred embodiments of the present invention will be described with reference to the accompanying drawings.

The die-cutting scrap removal device according to the present invention, as illustrated in FIGS. 3 to 6, is directed to a die-cutting scrap removal device 1 which is able to separate products (P) from an original plate (NP) on which a plurality of products (P) have been die-cut and may include, but is not limited to, a scrap removal part 100 which is formed of a table-shaped removal main body part 110 which stands upright on the ground, a fixed pressing-separation part 120 which is fixed on the upper surface of the removal main body part 110 and is configured to move vertically, and a movable pressing-separation part 130 which is configured to move back and forth and vertically on the upper surface of the removal main body part 110.

The fixed pressing-separation unit 120 may include a fixed pressing plate 121 on which an original plate (NP) loaded on the top of the removal main body part 110, is mounted, a fixed pressing part 122 which is configured to move vertically above the fixed pressing plate 121 and is connected passing through for the original plates (NP) to be pressed, and a fixed pressing cylinder 123 which is disposed below the fixed pressing plate 121 and is able to move vertically the fixed pressing part 122.

Moreover, the movable pressing-separation part 130 may include a movable pressing plate 131 which is disposed horizontal behind the fixed pressing plate 121 and is configured to move back and forth, a movable pressing part 132 which is configured to move vertically above the movable pressing plate 131 and is connected passing through for the original plates (NP) to be pressed, and a movable pressing cylinder 133 which is disposed below the movable pressing plate 131 and allows to move vertically the movable pressing part 132.

Furthermore, a pair of fixed vertical shaft rods 124 are disposed at the fixed pressing-separation part 120 so as to guide the vertical movements of the fixed pressing part 122. A fixed pressing transfer plate 125 is disposed at a lower end portion of the fixed vertical shaft rod 124 and is connected to the fixed pressing cylinder 123 and is able to move the fixed pressing part 122. A pair of movable vertical shaft rods 134 are disposed at the movable pressing-separation part 130 so as to guide the vertical movement of the movable pressing part 132. A movable pressing transfer plate 135 is disposed at a lower end portion of the movable vertical shaft rod 134 is connected to the movable pressing cylinder 133 and is able to move the movable pressing part 132.

Meanwhile, it is preferred that a plurality of ball bearing housings (not illustrated) are disposed at the fixed vertical shaft rod 124 and the movable vertical shaft rod 134 while passing through the fixed pressing plate 121 and the movable pressing plate 131.

Moreover, the fixed pressing part 122 may include a quadrangular rod-shaped fixed pressing body 122*a*, a Π-shaped fixed pressing body frame 122*b* to which both ends of the fixing pressing body 122*a* are connected rotatable, and a fixed rotation motor 122*c* which is disposed at one side of the fixed pressing body frame 122*b* and is configured to rotate the fixed pressing body 122*a*. The movable pressing part 132 may include a quadrangle rod-shaped movable pressing body 132*a*, a Π-shaped movable pressing body frame 132*b* to which both ends of the movable pressing body 132*a* are connected rotatable, and a movable rotation motor 132*c* which is disposed at one side of the movable pressing body frame 132*b* and is able to rotate the movable pressing body 132*a*.

Meanwhile, the Π-shapes of the fixed pressing body frame 122*b* and the movable pressing body frame 132*b* correspond to the shapes of the lateral cross sections thereof.

In addition, a pin fixing surface 151 may be formed at one surface of each of the fixed pressing body 122*a* and the movable pressing body 132*b*, wherein the pin fixing surface 151 is formed of a pressing pin 150 which allows one point of the original plate (NP) to be pressed and fixed, and a pin engaging hole 151*a* which is formed inwardly concave for the pressing pin 150 to be fixed. A plane fixed surface 152 may be formed at the other surface thereof for another point of the original plate (NP) to be pressed and fixed.

It is preferred that the pin engaging hole 151*a* is formed concave in a row in the longitudinal directions of the fixed pressing body 122*a* and the movable pressing body 132*a*.

The pressing pin 150 may include a mounting part 150*a* which is mounted on the pin fixing surface 151, and a pressing part 150*b* which is bent at a right angle at an end portion of the mounting part 150*a*. A longitudinal bolt through hole 150*a*' may be formed at one surface of the mounting part 150*a* for an engaging bolt (B) to pass through the longitudinal bolt through hole 150*a*'.

Figure 6:
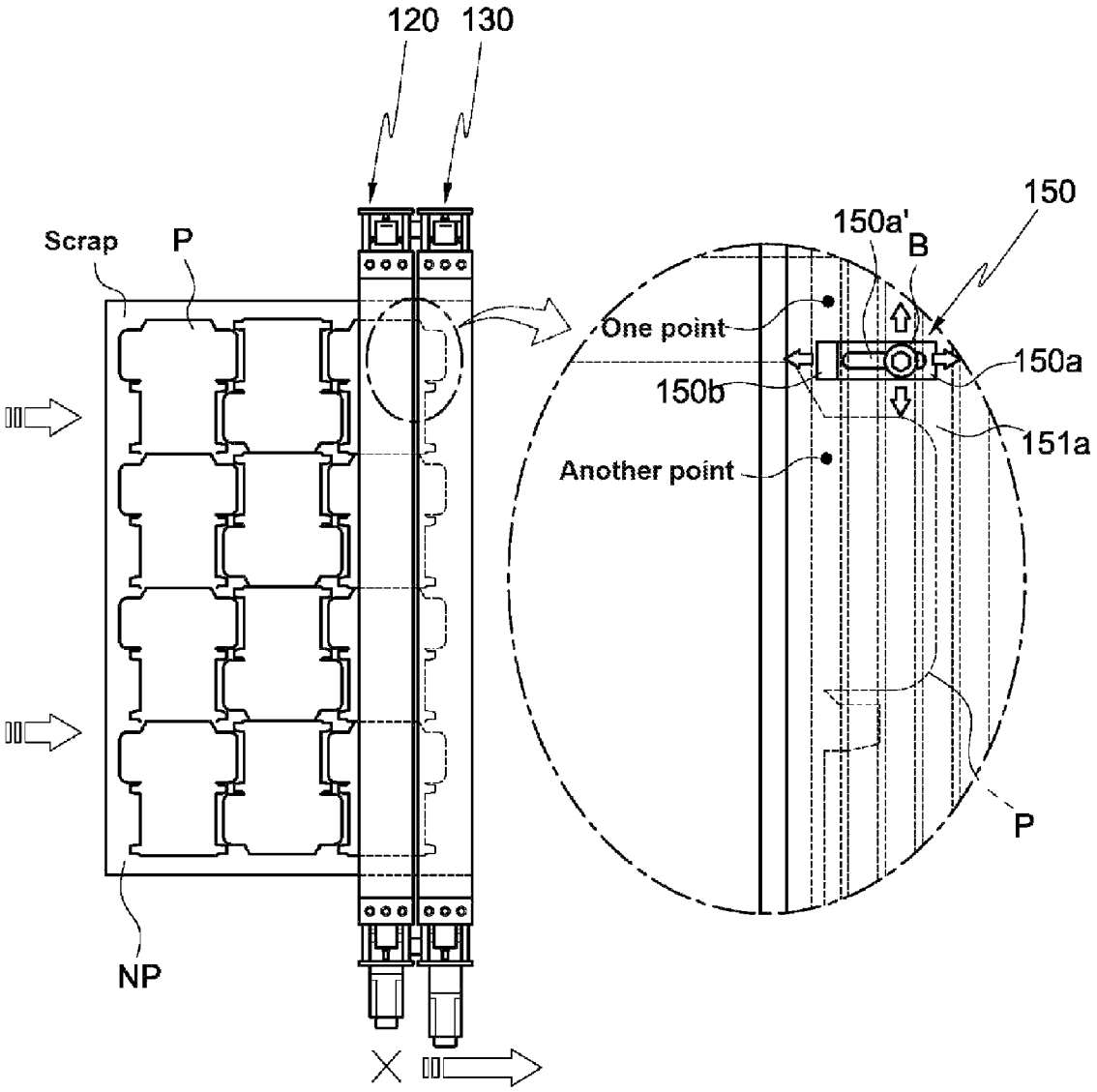
FIG. 6 is a plane cross sectional view illustrating a scrap removal part according to an embodiment of the present invention.
Figure 7:
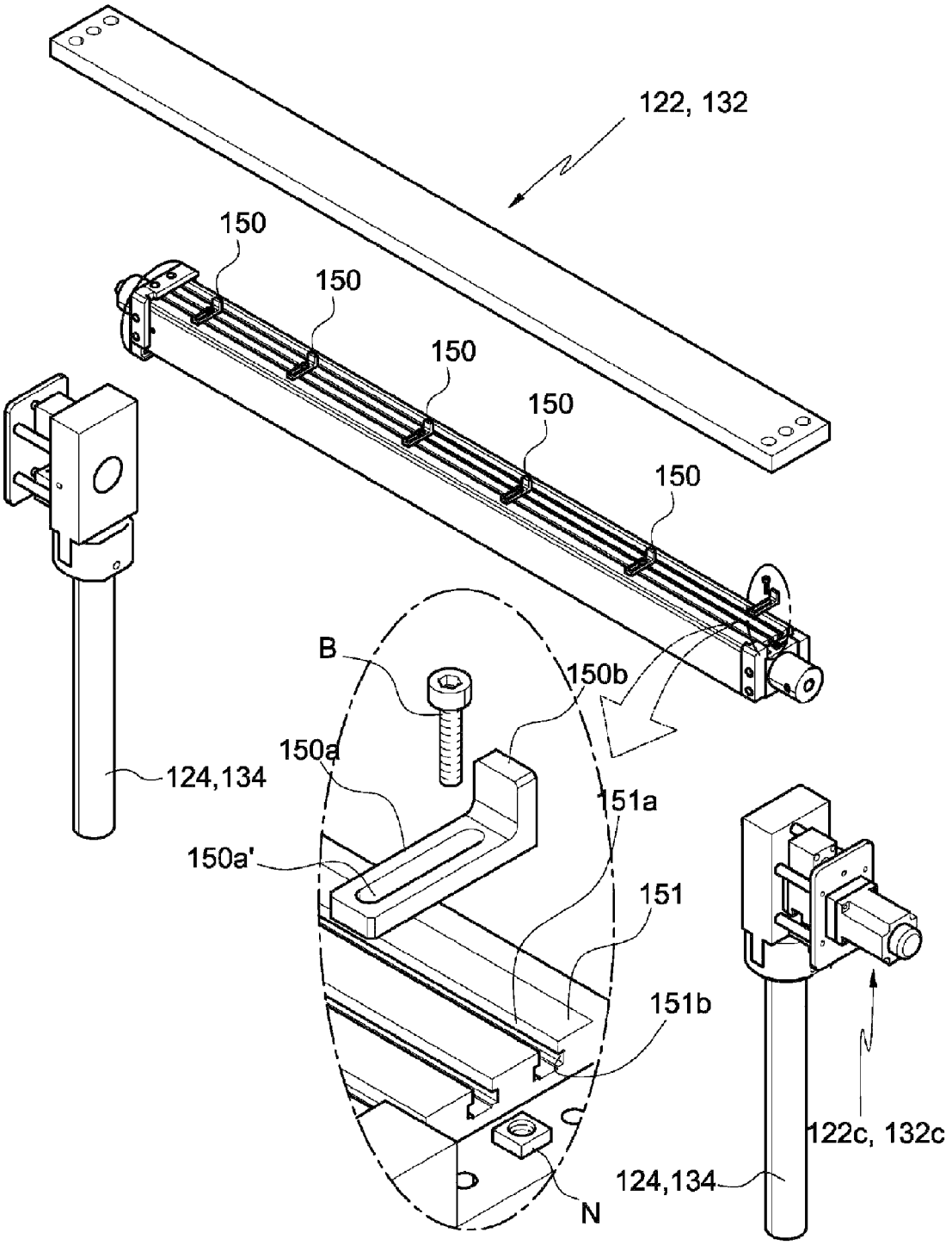
FIG. 7 is a perspective view illustrating a pressing body and a plurality of pressing pins according to the present invention.

Referring to FIGS. 6 and 7, in the pressing pin 150, an engaging groove 151*b* may be formed at an inner side of the pin engaging hole 151*a*, wherein the engaging groove 151*b* is formed outwardly concave. An engaging nut (N) may be provided at the engaging groove 151*b* and may be engaged with the engaging bolt (B), wherein the engaging nut (N) is larger than the inner diameter of the pin engaging hole 151*a* for the pressing pin 150 to be fixed.

Figure 8A:
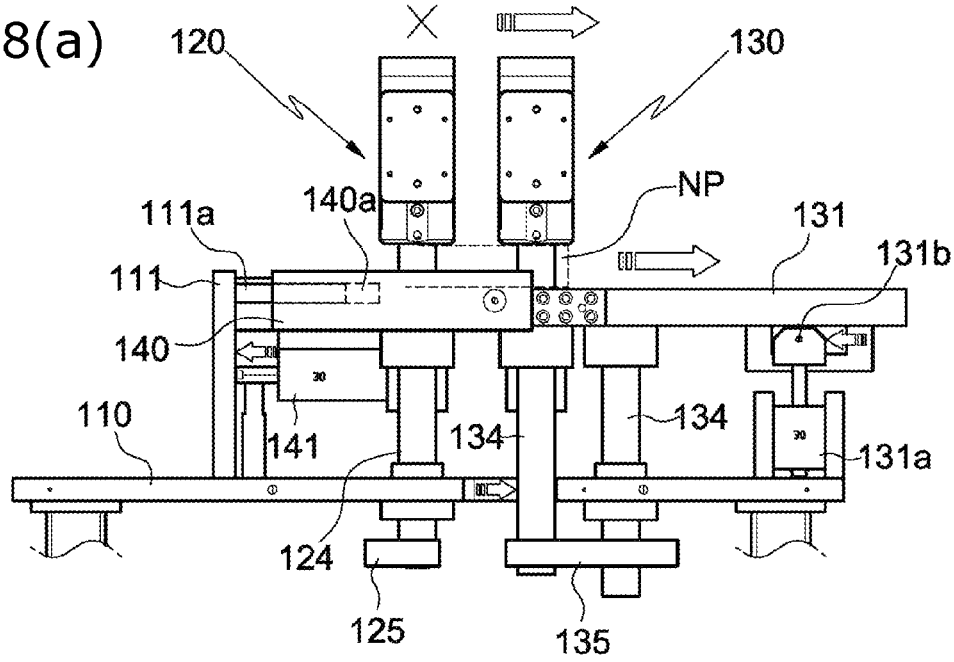
FIG. 8A is a view for describing a backward movement operation.
Figure 8B:
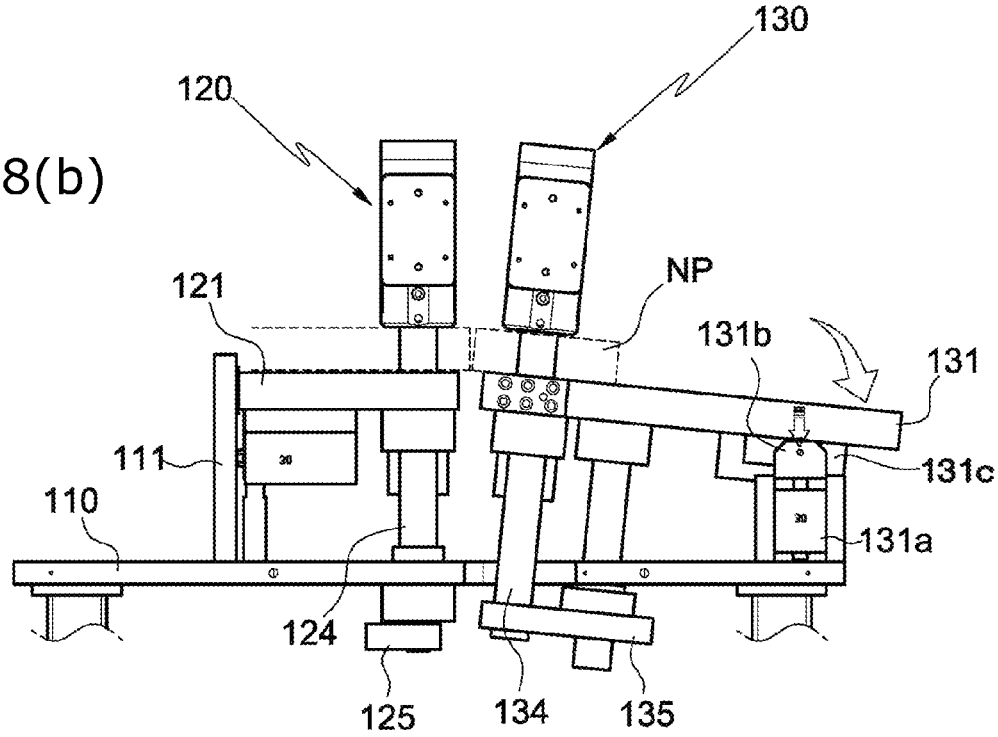
FIG. 8B is a view for describing a bending operation.

Moreover, as illustrated in FIG. 8, a forward and backward movement guide bar 140 may be formed at both sides of the movable pressing plate 131 while protruding in the direction of the fixed pressing plate 121, wherein a slide insertion hole 140*a* is formed inside the forward and backward movement guide bar 140. A plate-shaped forward and backward movement guide plate 111 may be disposed on the upper surface of the removal main body part 110, wherein the slide insertion rod 111*a* inserted in the slide insertion hole 140*a* is formed horizontal. A forward and backward movement cylinder 140 may be provided below the forward and backward movement guide bar 140 and is configured to push the forward and backward movement guide plate 111.

It is preferred that the forward and backward movement cylinder 141 is engaged to one surface of the forward and backward movement guide plate 111.

Meanwhile, it is preferred that a longitudinal movement vertical shaft rod connection hole (not illustrated) is formed on the upper surface of the removal main body part 110 in order for a movable vertical shaft rod 134 to readily move back and forth when the movable pressing plate 131 moves back and forth.

Moreover, a rotation hinge part 142 may be disposed at an end portion of the forward and backward movement guide bar 140 while being fixed at both sides of the movable pressing plate 131 so as to rotate in the upward and downward directions of the movable pressing plate 131, wherein the rotation hinge part 142 is hinged at an end portion of the forward and backward movement guide bar 140.

Furthermore, an elevating cylinder part 131*a* may be disposed at the lower surface of one side of the movable pressing plate 131 and may be configured to elevate the movable pressing plate 131 in order for the movable pressing plate 131 to move at a predetermined angle. An elevating rotary shaft part 131*b* may be disposed at an upper end portion of the elevating cylinder part 131*a* and may be connected to the movable pressing plate 131 so as to rotate during the elevating operation.

In the meantime, it is preferred that a longitudinal movable rotation part 131*c* may be formed at the elevating rotary shaft part 131*b* so as to prevent any interference when the movable pressing plate 131 moves backward.

The operation of the thusly constituted die-cutting scrap removal device according to the present invention will be described below.

Referring to FIGS. 3 to 6, the die-cutting scrap removal device according to the present invention is directed to a die-cutting scrap removal device 1 which is able to separate the products (P) from the original plates (NP) on which a lot of products (P) have been die-cut.

There is provided the scrap removal part 100 wherein a point between the products (P) on a plurality of the original plates (NP) on which various shape planar figures have been die-cut, is pressed, and subsequently one side thereof is fixed, and the other side thereof is moved in the direction of the backside, whereby the product (P) can be easily separated from the original plate (NP).

The aforementioned scrap removal part 100 includes the fixed pressing-separation part 120 equipped with a fixed pressing cylinder 123 at a lower portion thereof for the sake of only a vertical movement, and the movable pressing-separation part 130 equipped with a movable pressing cylinder 133 and a forward and backward movement cylinder 141 which are disposed behind the fixed pressing-separation part 120 so as to carry out the vertical movement and the forward and backward movements at the same time, by which the product (P) can be readily separated from the original plate (NP).

Referring to FIGS. 6 to 8, the fixed pressing cylinder 123 is configured to operate in the downward direction. The fixed pressing cylinder 123 is able to elevate the fixed pressing part 122 connected via the fixing vertical shaft rod 124 to the fixing pressing transfer plate 125 while moving the fixed pressing transfer plate 125, and the movable pressing cylinder 133 is able to elevate the movable pressing part 132 connected via the movable vertical shaft rod 134 to the movable pressing transfer plate 135 while moving the movable pressing transfer plate 135.

Moreover, the forward and backward movement cylinder 141 is engaged to one side of the forward and backward movement guide plate 111. The forward and backward movement cylinder 141 is able to move backward the movable pressing-separation part 130 when the rod of the forward and backward movement cylinder 141 comes out, and is able to move backward the movable pressing-separation part 130 when the rod goes in.

The forward and backward movement guide bar 140 is employed to insert the slide insertion rod 111*a* of the forward and backward movement guide plate 111, by which it is possible to prevent the movement trajectory from being deformed during the operation of the forward and backward movement cylinder 141.

Furthermore, a polyhedron-shaped fixed pressing body 122*a* and movable pressing body 132*a* are disposed at the fixed pressing-separation part 120 and the movable pressing-separation part 130 so as to prevent any damages to the product (P) when pressing the original plates (NP) and substantially fixing a point of the product (P). Any damages to the product (P) which might occur during the work to separate the product (P) from the original plate (NP), can be prevented in such a way to press a point of the original plate (NP) or the product (P) with the aid of the plane fixed surface 152 formed at the fixed pressing body 122*a* or the movable pressing body 132*a*.

As illustrated in FIGS. 6 and 7, the pressing pin 150 may allow easily move the pressing part 150*b* to the point thanks to the presence of a longitudinal bolt through hole 150*a*' and the pin engaging hole 151*a* formed concave in a row in the direction of one side.

In the meantime, an engaging groove 151*b* formed inwardly concave at in both directions in the cross section shape of the inverted "T" may be disposed at the inner side of the pin engaging hole 151*a* of the pin engaging hole 151*a*, and an engaging nut (N) which is larger than the inner diameter of the pin engaging hole 151*a*, may be provided at the engaging groove 151*b*, whereupon the pressing pin 150 can be easily fixed after it has been moved to the point.

Since the fixed rotation motor 122*c* and the movable rotation motor 132*c* are provided at one side for the fixed pressing body 122*a* and the movable pressing body 132*a* to be rotatable, necessary works can be readily carried out while easily moving the pin fixing surface 151 and the plane fixing surface 152 in response to the position of the original plate (NP).

Moreover, since the elevating cylinder 131*a* configured to elevate the movable pressing plate 131 for the movable pressing plate 131 to move at a predetermined angle is disposed at the lower surface of one side of the movable pressing plate 131, and the elevating rotary shaft part 131*b* is disposed at the lower surface of the other side, a plurality of the original plates (NP) can be separated in such a way that they are bent rotating about the elevating rotary shaft part 131*b* during when the elevating cylinder part 131*a* operates, whereupon workability can be greatly enhanced.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

Legend of reference numbers

| | |
|---|---|
| 1: Scrap removal device | 100: Scrap removal part |
| 110: Removal main body part | 111: Forward and backward movement guide plate |

-continued

| Legend of reference numbers | |
|---|---|
| 111a: Slide insertion rod | 120: Fixed pressing-separation part |
| 121: Fixed pressing plate | 122: Fixed pressing part |
| 122a: Fixed pressing body | 122b: Fixed pressing body frame |
| 122c: Fixed rotation motor | 123: Fixed pressing cylinder |
| 124: Fixed vertical shaft rod | 125: Fixed pressing transfer plate |
| 130: Movable pressing-separation part | 131: Movable pressing plate |
| 131a: Elevating cylinder part | 131b: elevating rotary shaft part |
| 132: Movable pressing part | 132a: Movable pressing body |
| 132b: Movable pressing body frame | 132c: Movable rotation motor |
| 133: Movable pressing cylinder | 134: Movable vertical shaft rod |
| 135: Movable pressing transfer plate | 140: Forward and backward movement guide bar |
| 140a: Slide insertion hole | 141: Forward and backward movement cylinder |
| 142: Rotation hinge part | 150: Pressing pin |
| 150a: Mounting part | 150b: Pressing part |
| 150a': Bolt through hole | 151: Pin fixing surface |
| 151a: Pin engaging hole | 151b: Engaging groove |
| B: Engaging bolt | N: Engaging nut |
| 152: Plane fixed surface | 150a': Pin fixed cut-away part |
| NP: Original plate | |

What is claimed is:

1. A die-cutting scrap removal device configured to separate a product from an original plate on which a plurality of products have been die-cut, comprising:

a table-shaped removal main body part configured to stand upright on the ground, a first pressing-separation part fixed on an upper surface of the removal main body part, the first pressing-separation part being configured to move vertically, and a second pressing-separation part configured to move back and forth and vertically on the upper surface of the removal main body part, wherein the first pressing-separation part comprises a first pressing plate on which the original plate is loaded, the first pressing plate being disposed above the removal main body part, a first pressing part configured to move vertically above the first pressing plate, a pair of first vertical shaft rods are disposed at the first pressing part so as to guide the vertical movements of the first pressing part, the pair of the first vertical shaft rods passing through the first pressing plate, a first pressing cylinder disposed below the first pressing plate, the first pressing cylinder being configured to move the first pressing part vertically, and a first pressing transfer plate is disposed at lower ends of the first vertical shaft rods and is connected to the first pressing cylinder to move the first pressing part, and wherein the second pressing-separation part comprises a second pressing plate disposed horizontal behind the first pressing plate, the second pressing plate being configured to move back and forth, a second pressing part configured to move vertically above the second pressing plate, a pair of second vertical shaft rods are disposed at the second pressing part so as to guide the vertical movement of the second pressing part, the pair of the second vertical shaft rods passing through the second pressing plate, a second pressing cylinder disposed below the second pressing plate, the second pressing cylinder being configured to move vertically the second pressing part, and a second pressing transfer plate is disposed at lower ends of the second vertical shaft rods and is connected to the second pressing cylinder to move the second pressing part.

2. The device of claim 1, wherein the first pressing part includes a quadrangular rod-shaped first pressing body, a first pressing body frame to which both ends of the first pressing body are rotatably connected, and a first rotation motor disposed at one side of the first pressing body frame and configured to rotate the first pressing body; and the second pressing part includes a quadrangle rod-shaped second pressing body, a second pressing body frame to which both ends of the second pressing body are rotatably connected, and a second rotation motor disposed at one side of the second pressing body frame and configured to rotate the second pressing body.

3. The device of claim 2, wherein a pin fixing surface is formed at one surface of each of the first pressing body and the second pressing body, the pin fixing surface comprising a pressing pin for pressing and fixing one point of the original plate, and a pin engaging hole for fixing the pressing pin, the pin engaging hole being formed inwardly concave, and wherein a plane fixed surface is formed at an other surface of each of the first pressing body and the second pressing body for another point of the original plate to be pressed and fixed.

4. The device of claim 3, wherein the pressing pin includes a mounting part mounted on the pin fixing surface, and a pressing part bent at a right angle at an end portion of the mounting part; and wherein a longitudinal bolt through hole is formed at the mounting part for an engaging bolt to pass through the longitudinal bolt through hole.

5. The device of claim 4, wherein an engaging groove is formed at an inner side of the pin engaging hole, the engaging groove being formed outwardly concave, and an engaging nut for engaging with the engaging bolt is provided at the engaging groove, the engaging nut being larger than an inner diameter of the pin engaging hole.

6. The device of claim 1, wherein a forward and backward movement guide bar is formed at both sides of the second pressing plate while protruding in the direction of the first pressing plate, wherein a slide insertion hole is formed inside the forward and backward movement guide bar, and a plate-shaped forward and backward movement guide plate is disposed on the upper surface of the removal main body part, wherein a slide insertion rod configured to be inserted in the slide insertion hole is formed in a horizontal direction, and a forward and backward movement cylinder is provided below the forward and backward movement guide bar and is configured to push the forward and backward movement guide plate.

7. The device of claim 6, wherein a rotation hinge part is disposed at an end portion of the forward and backward movement guide bar while being fixed at both sides of the second pressing plate so as to rotate in upward and downward directions of the second pressing plate, wherein the rotation hinge part is hinged at the end portion of the forward and backward movement guide bar.

8. The device of claim 1, wherein an elevating cylinder part is disposed at a lower surface of one side of the second pressing plate and is configured to elevate or descend the second pressing plate in order for the second pressing plate to move at a predetermined angle, and an elevating rotary shaft part is disposed at an upper end portion of the elevating cylinder part and is rotatably connected to the second pressing plate so as to rotate during an elevating or descending operation.

* * * * *